US010859947B2

(12) United States Patent
Yoshida

(10) Patent No.: US 10,859,947 B2
(45) Date of Patent: Dec. 8, 2020

(54) TONER CONTAINER HAVING OPERATION MEMBER FOR MAKING SHUTTER OPEN OR CLOSE AND IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/746,175

(22) Filed: Jan. 17, 2020

(65) Prior Publication Data

US 2020/0233337 A1 Jul. 23, 2020

(30) Foreign Application Priority Data

Jan. 22, 2019 (JP) ..... 2019-008731

(51) Int. Cl.
*G03G 15/08* (2006.01)

(52) U.S. Cl.
CPC ..... *G03G 15/0886* (2013.01); *G03G 15/0875* (2013.01); *G03G 2215/0668* (2013.01)

(58) Field of Classification Search
None
See application file for complete search history.

(56) References Cited

U.S. PATENT DOCUMENTS 8,995,885 B2 3/2015 Fujii
2007/0212118 A1* 9/2007 Nagae ..... G03G 15/0875 399/260
2011/0249991 A1* 10/2011 Hosokawa ..... G03G 15/0886 399/262
2012/0172812 A1* 7/2012 Plumptre ..... A61M 5/31525 604/207

FOREIGN PATENT DOCUMENTS

JP 2013250428 A 12/2013

* cited by examiner

*Primary Examiner* — Victor Verbitsky
(74) *Attorney, Agent, or Firm* — Studebaker & Brackett PC

(57) ABSTRACT

A toner container includes a container body, a shutter, and an operation member. The container body contains a toner and has a discharging port discharging the toner. The shutter opens or closes the discharging port. The operation member is operated between a first operation position making the shutter close the discharging port and a second operation position making the shutter open the discharging port. In an upper face of the container body, a recessed part is provided in an area including an end at a side of the operation member. In the recessed part, an inclined face inclined upwardly from an upstream side to a downstream side in an operation direction when the operation member is operated from the first operation position to the second operation position is provided.

11 Claims, 10 Drawing Sheets

TONER CONTAINER HAVING OPERATION MEMBER FOR MAKING SHUTTER OPEN OR CLOSE AND IMAGE FORMING APPARATUS

INCORPORATION BY REFERENCE

This application is based on and claims the benefit of priority from Japanese Patent application No. 2019-008731 filed on Jan. 22, 2019, the entire contents of which are incorporated herein by reference.

BACKGROUND

The present disclosure relates to a toner container and an image forming apparatus including this toner container.

Conventionally, an image forming apparatus of an electrographic manner supplies a toner from a developing device to an image carrier, such as a photosensitive drum, to thereby form a toner image. Such a toner used for forming of the toner image is replenished from the toner container to the developing device. The toner container is detachably attached to an installation part provided in the image forming apparatus.

The toner container has a discharging port discharging the toner to the developing device. If the toner container is detached from the developing device in a state that this discharging port is opened, it is feared that the toner is leaked from the discharging port to the outside. Thereupon, in the toner container, a shutter opening/closing the discharging port is provided.

For example, there is the toner container including a container body having the discharging port for the toner, the shutter opening/closing the discharging port and an operation member operated between an operation position making the shutter closed the discharging port and another operation position making the shutter opened the discharging port.

In the above-mentioned toner container, due to a connecting mechanism of the operation member and the shutter, relatively large force is required for operating the operation member. Particularly, in a case where a sealing member preventing toner leak is located between the shutter and the container body, because frictional force acting between the sealing member and the shutter becomes a load applied to operation of the operation member, force required for operating the operation member becomes larger. According to this, it is feared that the operation member is hardly operated.

SUMMARY

In accordance with an embodiment of the present disclosure, a toner container includes a container body, a shutter, and an operation member. The container body contains a toner and has a discharging port discharging the toner. The shutter opens or closes the discharging port. The operation member is operated between a first operation position making the shutter close the discharging port and a second operation position making the shutter open the discharging port. In an upper face of the container body, a recessed part is provided in an area including an end at a side of the operation member. In the recessed part, an inclined face inclined upwardly from an upstream side to a downstream side in an operation direction when the operation member is operated from the first operation position to the second operation position is provided.

In accordance with an embodiment of the present disclosure, an image forming apparatus includes the above-mentioned toner container, and an installation part to which the toner container is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus 1 according to embodiments of the present disclosure will be described with reference to the drawings. For convenience, it will be described so that the front side of the image forming apparatus 1 is positioned at a left side on a paper sheet of FIG. 1. Arrows Fr, Rr, L, R, U and Lo in each of the drawings respectively indicate a front side, a rear side, a left side, a right side, an upper side and a lower side of the printer 1.

First, the entire structure of the image forming apparatus 1 will be described.

Figure 1:
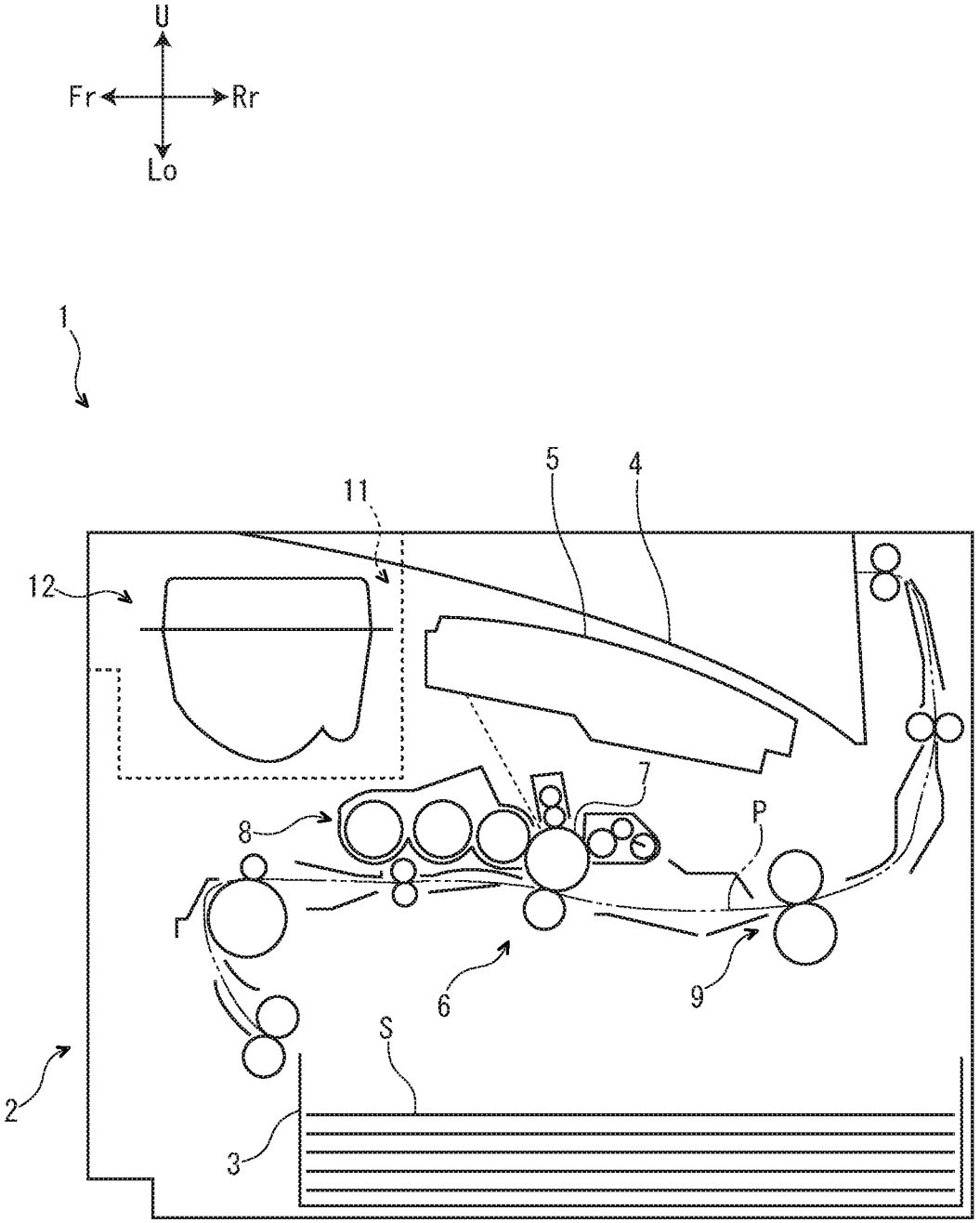
FIG. 1 is a sectional view schematically showing an image forming apparatus according to an embodiment of the present disclosure.

With reference to FIG. 1, the image forming apparatus 1 is, for example, a printer. The image forming apparatus 1 includes a box-shaped apparatus body 2. In a lower part of the apparatus body 2, a sheet feeding cartridge 3 storing sheets S (an example of a recording medium) is installed. In a top face of the apparatus body 2, an ejected sheet tray 4 is provided. In an upper part of the apparatus body 2, an exposure device 5 is installed below the ejected sheet tray 4.

Inside the apparatus body 2, a conveying path P for the sheet S is arranged. At an intermediate stream part of the conveying path P, an image forming part 6 is provided. The image forming part 6 has a photosensitive drum 7 and a developing device 8. At a downstream part of the conveying path P, a fixing device 9 is provided.

In a front upper part, an installation part 11 is provided above the developing device 8. In the installation part 11, a toner container 12 is detachably attached.

Next, operation of the image forming apparatus 1 having such a configuration will be described.

First, by a laser light (refer to an arrow of a broken line in FIG. 1) from the exposure device 5, an electrostatic latent image is formed on the photosensitive drum 7. Subsequently, the electrostatic latent image on the photosensitive drum 8 is developed by the developing device 8, and then, a toner image is formed. Thereby, the image forming operation is completed.

On the other hand, the sheet S picked up from the sheet feeding cartridge 3 is conveyed to the image forming part 6 in a timing synchronized with the above-described image forming operation. In the image forming part 6, the above-described toner image is transferred from the photosensitive drum 6 to the sheet S. The sheet S with the transferred toner image is conveyed to a downstream side on the conveying path P to enter the fixing device 9 and, in the fixing device 9, the toner image is fixed on the sheet S. The sheet S with the fixed toner image is ejected from a downstream end of the conveying path P to the sheet ejected tray 4.

Next, the installation part 11 will be further described.

Figure 2:
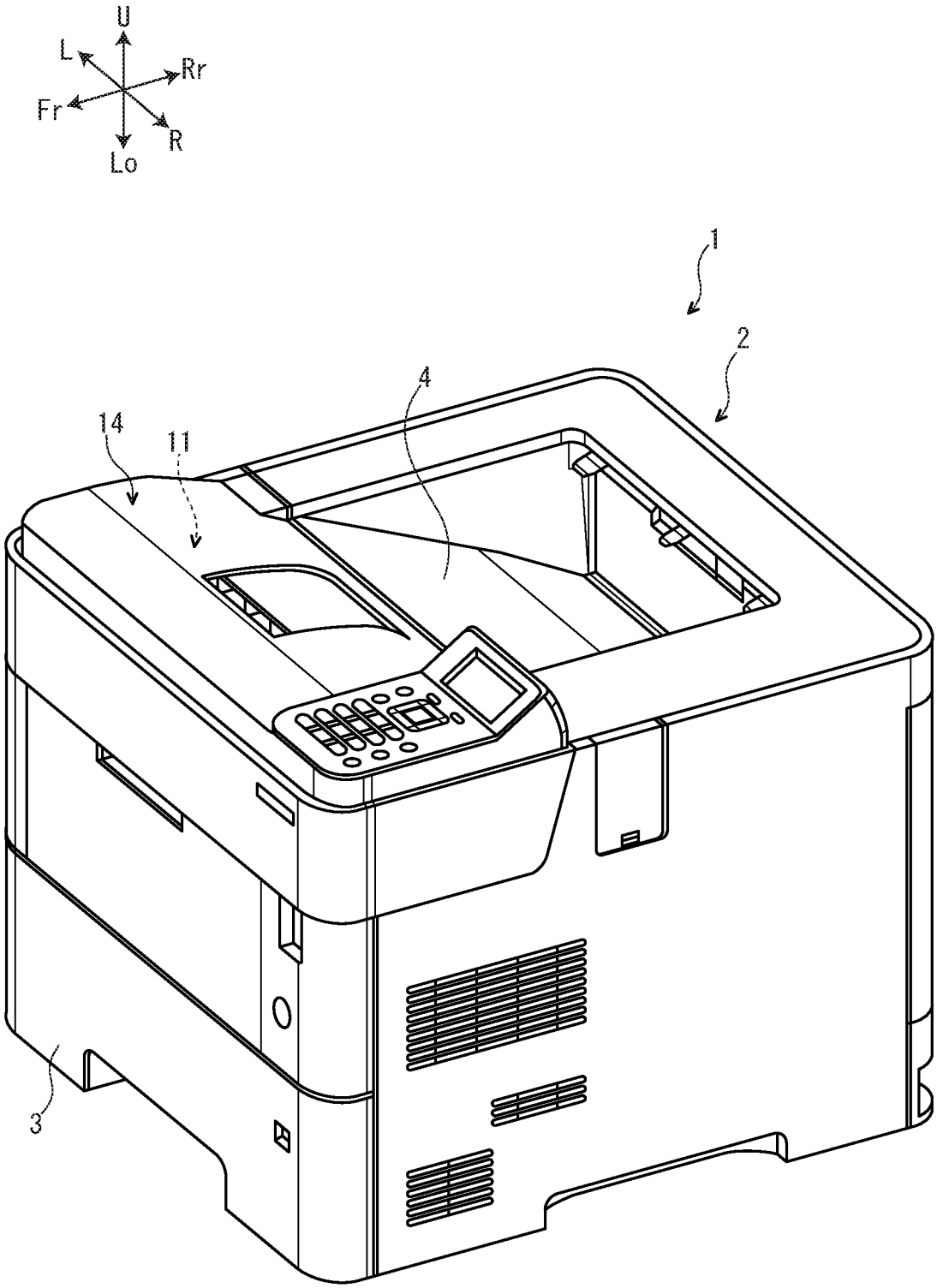
FIG. 2 is a perspective view showing the image forming apparatus, in a state an upper cover is closed, according to the embodiment of the present disclosure.
Figure 3:
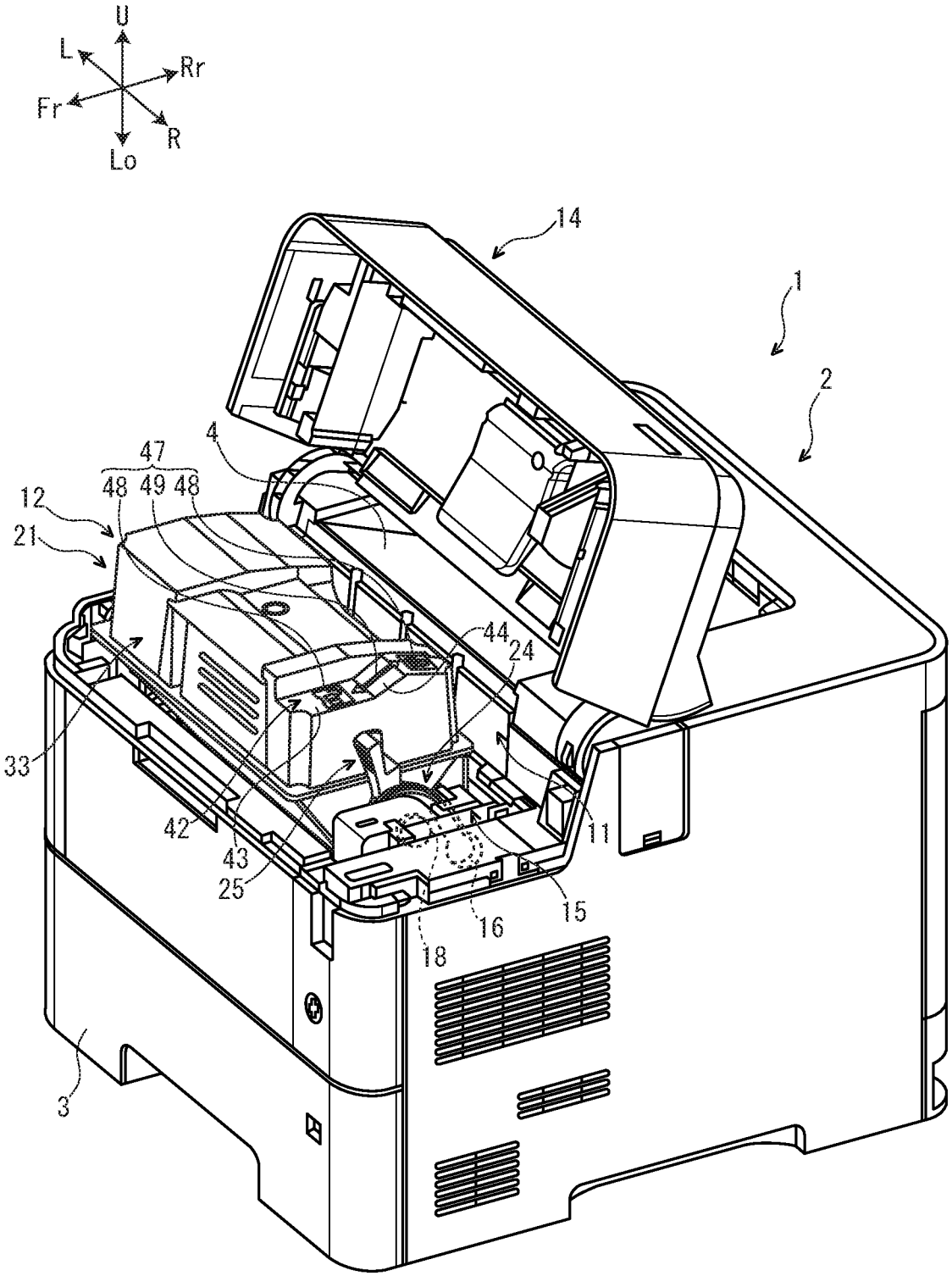
FIG. 3 is a perspective view showing the image forming apparatus, in a state the upper cover is opened, according to the embodiment of the present disclosure.

With reference to FIGS. 2 and 3, an upper part of the installation part 11 is covered by an openable/closable upper cover 14. In a right end of the installation part 11, a locked gap 16 is provided. The locked gap 16 is opened toward an upper side. In a right end of the installation part 11, a driving coupling 18 is rotatably provided in front of the locked gap 16. The driving coupling 18 is connected to a driving source (not shown) composed of a motor or the like.

Next, the toner container 12 will be further described.

Figure 4:
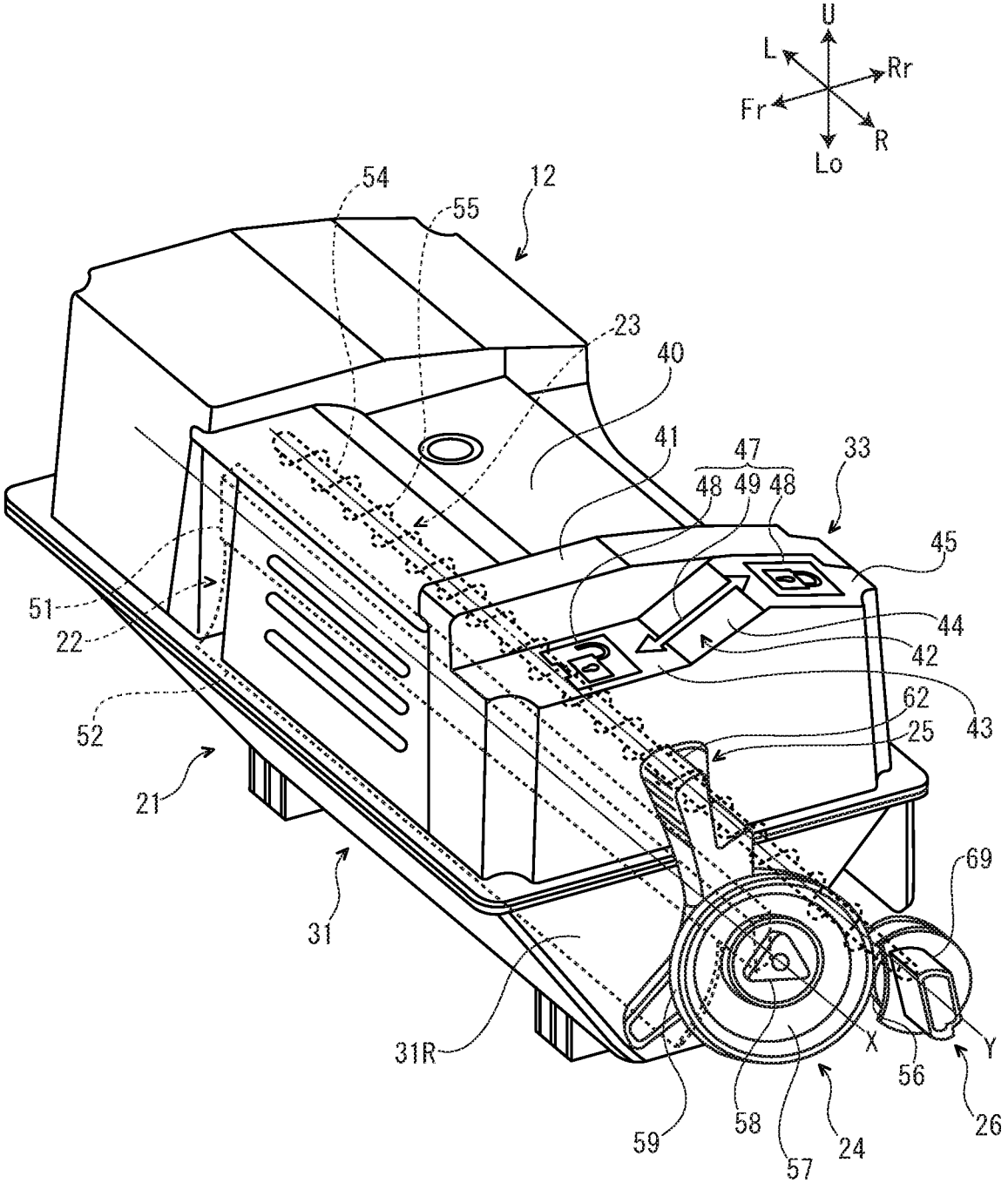
FIG. 4 is a perspective view showing a toner container according to the embodiment of the present disclosure.

With reference to FIG. 4, the toner container 12 includes a container body 21, an agitating member 22 and a conveying member 23 housed in the container body 21, a transmitting member 24 and an operation member 25 provided at a right side (an outside in left and right directions) of the container body 21, and a shutter 26 provided at a rear lower side of a right end of the container body 21. Incidentally, the transmitting member 24 is not shown in FIG. 5 and after. Hereinafter, the above-described components of the toner container 12 will be described in order.

With reference FIG. 4, the container body 21 of the toner container 12 is formed in a long shape in the left and right directions. That is, in the present embodiment, the left and right directions are a longitudinal direction of the container body 21, and forward and backward directions are a width direction of the container body 21. The container body 21 contains the toner.

With reference to FIGS. 5-8, the container body 21 of the toner container 12 includes a base part 31, a duct part 32 provided at a rear lower side of the base part 31 and a lid part 33 provided at an upper side of the base part 31.

The base part 31 of the container body 21 is formed in a box shape in which an upper face is opened. In a center part of a right side wall 31R of the base part 31, a cylindrical boss 35 is protruded to a right side (an outside in the left and right directions).

The duct part 32 of the container body 21 is formed in a cylindrical shape and is extended along the left and right directions. The duct part 32 is integrally formed with the base part 31. An inner space of the duct part 32 is directly communicated with an inner space of the base part 31. In a lower face of the duct part 32, a discharging port 37 for the toner is provided. Onto an outer circumference face of the duct part 32, a sealing member 38 is fixed around the discharging port 37 for the toner.

The lid part 33 of the container body 21 is formed in a box shape in which a lower face is opened. A lower end of the lid part 33 is fixed to an upper end of the base part 31. Thereby, the base part 31 and the lid part 3 is integrally formed with each other, and the lid part 33 closes an upper face of the base part 31. An inner space of the lid part 33 is directly communicated with the inner space of the base part 31.

With reference to FIG. 4, in a center part in the left and right directions of an upper face of the lid part 33, a depression part 40 is provided. The depression part 40 is extended from a front face to a rear face of the lid part 33 along the forward and backward directions.

In a right side part of the upper part of the lid part 33, a protrusion part 41 is provided. The protrusion part 41 is provided at a right side of the depression part so as to continue to the depression part 40. The protrusion part 41 is extended from the front face to the rear face of the lid part 33 along the forward and backward directions.

Figure 5:
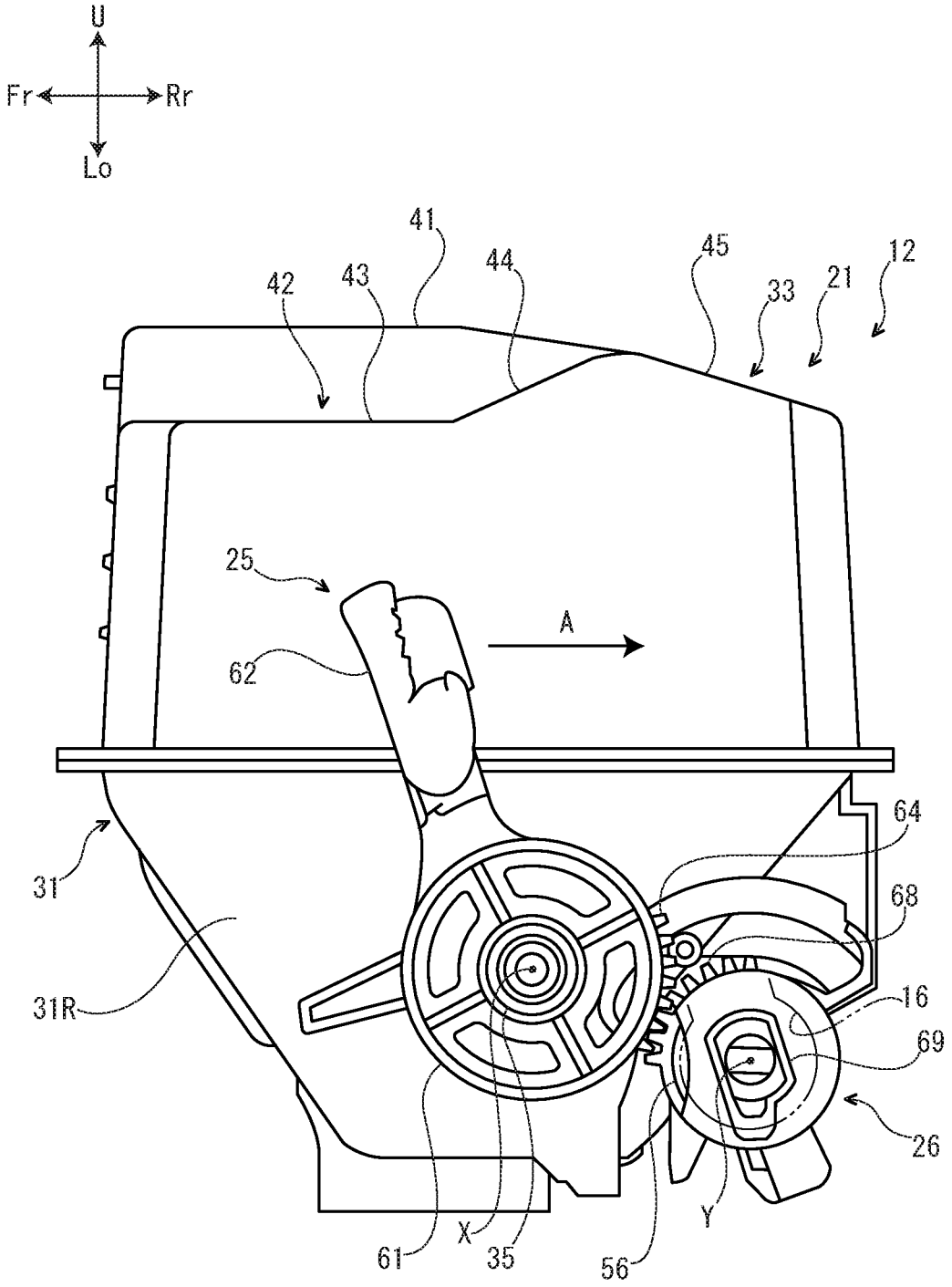
FIG. 5 is a side view showing the toner container, in a state that an operation member is positioned at a first operation position, according to the embodiment of the present disclosure.
Figure 6:
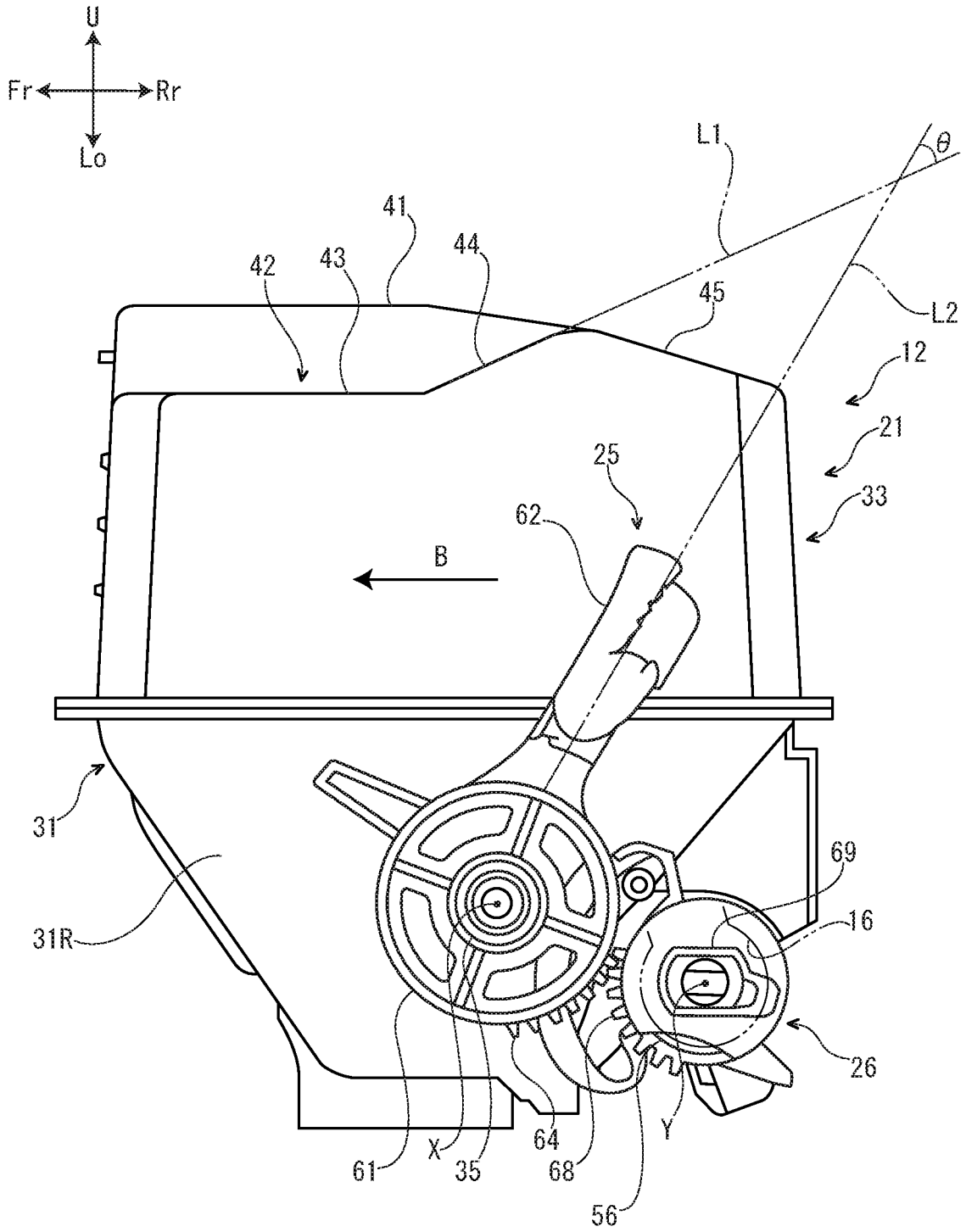
FIG. 6 is a side view showing the toner container, in a state that the operation member is positioned at a second operation position, according to the embodiment of the present disclosure.

With reference to FIGS. 4-6, in a right end (an end at a side of the operation member 25) of the upper face of the lid part 33, a recessed part 42 is provided. The recessed part 42 is provided at a right side (the side of the operation member 25) of the protrusion part 41 so as to continue to the protrusion part 41. The recessed part 42 is extended from the front face of to a rear part of the upper face of the lid part 33 along the forward and backward directions.

The recessed part 42 of the lid part 33 includes a horizontal face 43, and an inclined face 44 provided at the rear side (one side in the forward and backward directions) of the horizontal face 43. The horizontal face 43 is horizontally provided. The inclined face 44 is inclined upwardly from the front side to the rear side. A front end of the inclined face 44 is positioned at the rear side from the front end of the operation member 25, and a rear end of the inclined face 44 is positioned at the front side from the rear end of the operation member 25. That is, the position of the inclined face 44 in the forward and backward directions (the width direction of the container body 21) is overlapped with the position of the operation member 25 in the forward and backward directions as a whole.

In the right end (the end at a side of the operation member 25) of the upper face of the lid part 33, an inclined part 45 is provided at the rear side (one side in the forward and backward directions) of the recessed part 42. The inclined part 45 is inclined downwardly from the front side to the rear side. That is, the inclined part 45 is inclined in an opposite direction to the inclined face 44 of the recessed part 42 with regard to the horizontal face.

With regard to FIG. 4, on the right end (the end at a side of the operation member 25) of the upper face of the lid part 33, a direction indicating part 47 indicating an operation direction of the operation member 25 is provided. The direction indicating part 47 includes a pair of front and rear key marks 48 (an example of marks) and an arrow 49 arranged between the pair of front and rear key marks 48.

The front key mark 48 of the direction indicating part 47 of the lid part 33 is provided on the horizontal face 43 of the recessed part 42. That is, the front key mark 48 is provided at the outside of the inclined part 44 of the recessed part 42. The front key mark 48 illustrates that the toner container 12 is in an unlocked state (detachment of the toner container 12 from the installation part 11 is allowed).

The rear key mark 48 of the direction indicating part 47 of the lid part 33 is provided on the inclined part 45. That is, the rear key mark 48 is provided at the outside of the inclined part 44 of the recessed part 42. The rear key mark 48 illustrates that the toner container 12 is in a locked state (detachment of the toner container 12 from the installation part 11 is regulated).

The arrow 49 of the direction indicating part 47 of the lid part 33 is extended along the forward and backward directions. A front end of the arrow 49 indicates the front key mark 48 and a rear end of the arrow 49 indicates the rear key mark 48. A center part of the arrow 49 in the forward and backward directions is provided in the inclined face 44 of the recessed part 42.

With reference to FIG. 4, the agitating member 22 of the toner container 12 is housed in the base part 31 and the lid part 33 of the container body 21. The agitating member 22 is rotatably provided around a rotation axis X extended in the left and right directions. That is, in the present embodiment, the left and right directions are a rotation axis direction of the agitating member 22.

The agitating member 22 includes an agitating shaft 51 extended along the rotation axis X and an agitating blade 52 fixed to the agitating shaft 51. The agitating shaft 51 is rotatably supported to the base part 31 of the container body 21. The agitating blade 52 is composed of a film made from resin and has flexibility.

Figure 7:
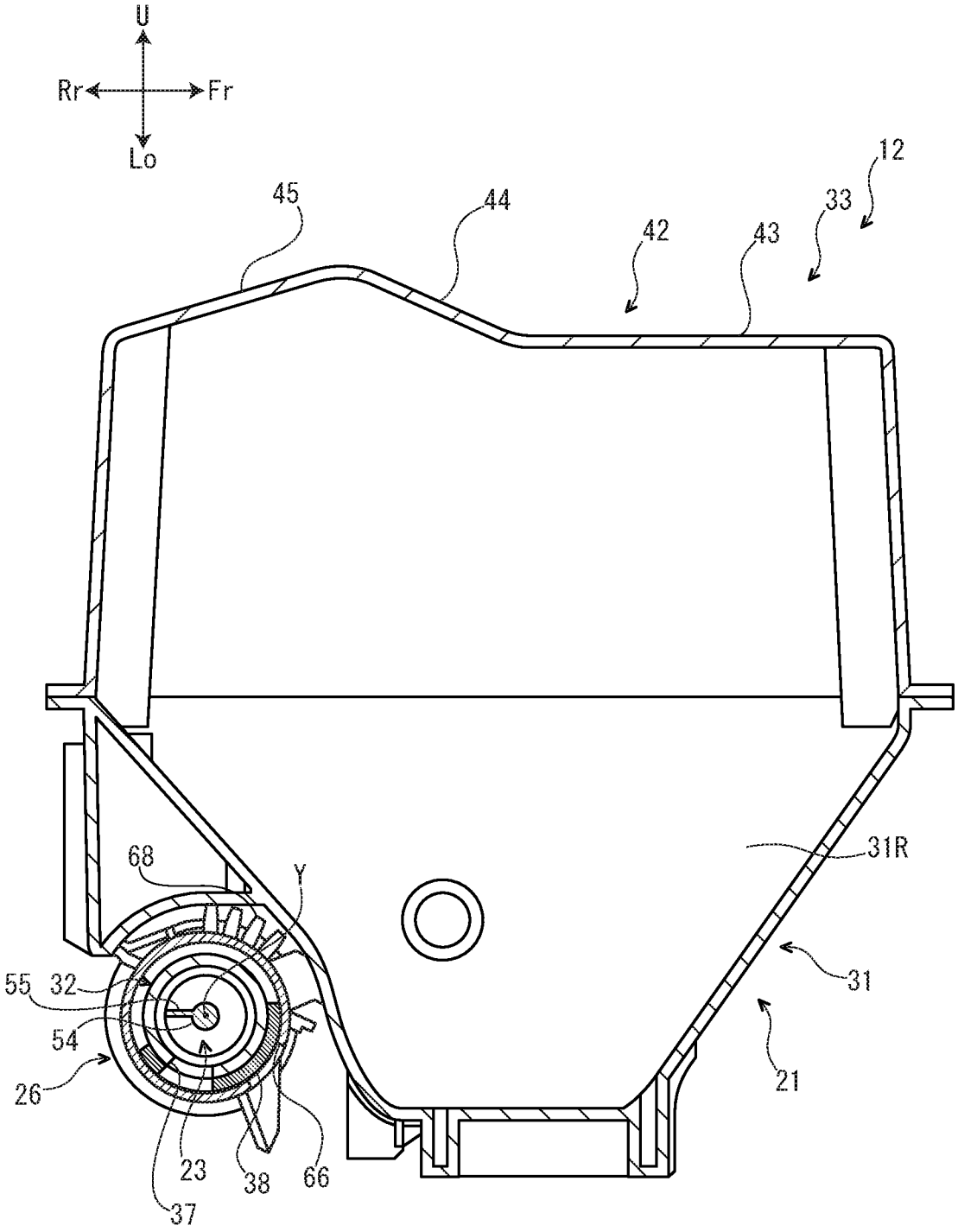
FIG. 7 is a sectional view showing the toner container, in a state that a shutter is positioned at a closing position, according to the embodiment of the present disclosure.
Figure 8:
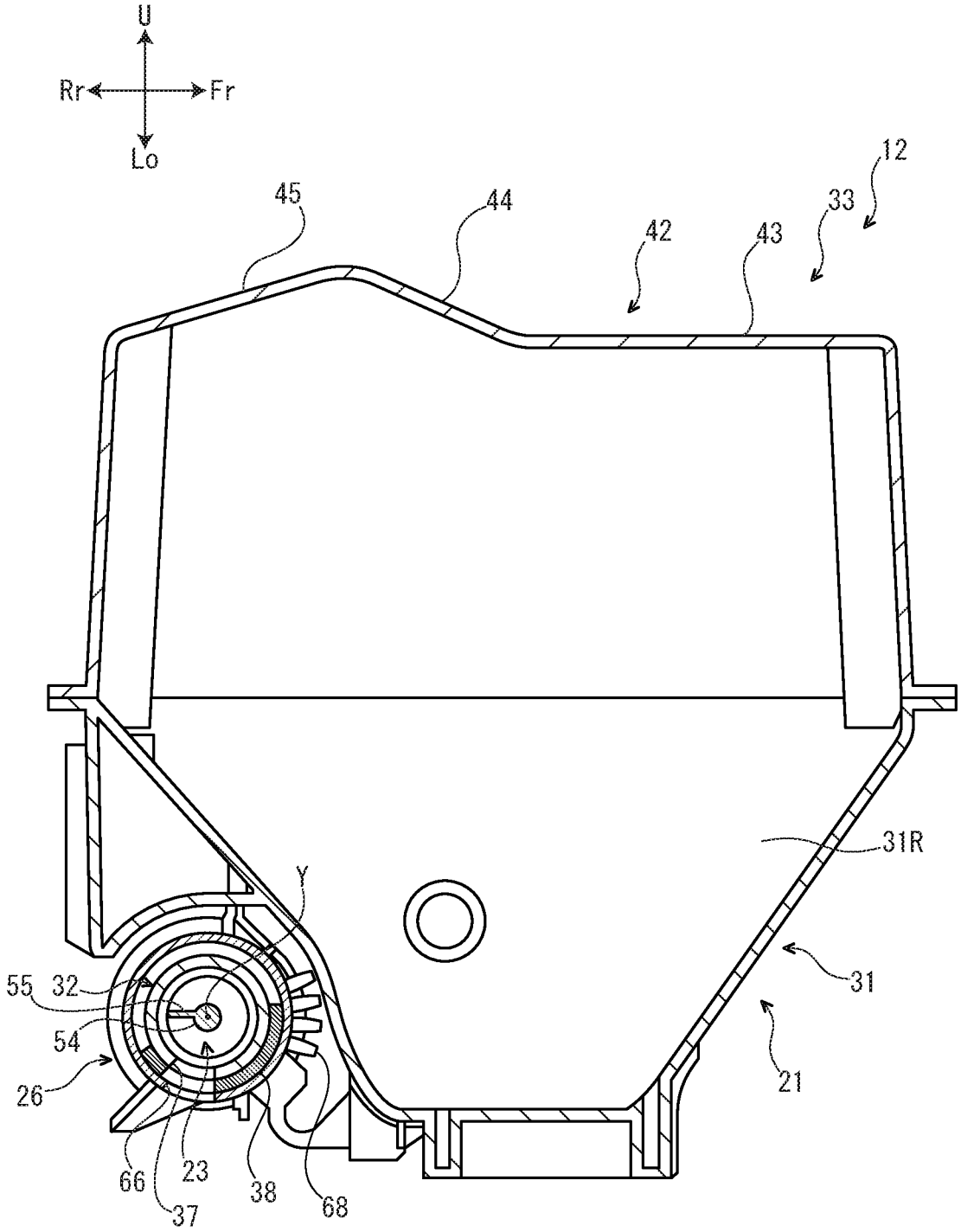
FIG. 8 is a sectional view showing the toner container, in a state that the shutter is positioned at an opening position, according to the embodiment of the present disclosure.

With regard to FIGS. 4, 7 and 8, the conveying member 23 of the toner container 12 is housed in the base part 31 and the duct part 32 of the container body 21. The conveying member 23 is rotatably provided around a rotation axis Y extended in the left and right directions. That is, in the present embodiment, the left and right directions are a rotation axis direction of the conveying member 23.

The conveying member 23 includes a conveying shaft extended along the rotation axis Y and a helical conveying fin 55 provided on an outer circumference of the conveying shaft 54. The conveying shaft 54 is rotatably supported to the base part 31 of the container body 21. In a right end of the conveying shaft 54, a conveying gear 56 is provided.

With reference to FIG. 4, the transmitting member 24 of the toner container 12 is rotatably provided around the rotation axis X. The transmitting member 24 includes a disc-shaped transmitting piece 57, an engaging piece (not shown) protruded from a left face (an inside face in the left and right directions) of the transmitting piece 57 and a transmitting coupling 58 protruded from a right face (an outside face in the left and right directions) of the transmitting piece 57.

The transmitting piece 57 of the transmitting member 24 is provided at the outside of the container body 21. Onto the outer circumference face of the transmitting piece 57, a transmitting gear 59 is provided. The transmitting gear 59 is meshed with the conveying gear 56 fixed to the conveying shaft 54 of the conveying member 23. Thereby, the transmitting member 24 and the conveying member 23 are connected to each other.

The engaging piece (not shown) of the transmitting member 24 penetrates the boss 35 of the base part 31 of the container body 21 and is fixed to the agitating shaft 51 of the agitating member 22. Thereby, the transmitting member 24 and the agitating member 22 are connected to each other.

The transmitting coupling 58 of the transmitting member 24 is provided at the outside of the container body 21. The transmitting coupling 58 is connected to the driving coupling 18 (refer to FIG. 3) of the installation part 11 in a state that the toner container 12 is installed in the installation part 11.

With reference to FIGS. 4-6, the operation member 25 of the toner container 12 is provided at the outside of the container body 21. The operation member 25 includes a disc-shaped body part 61 and a bar-shaped lever part 62 linearly extended upwardly from an outer circumference face of the body part 61.

The body part 61 of the operation member 25 is arranged between the right side wall 31R of the base part 31 of the container body 21 and the transmitting piece 57 of the transmitting member 24. Therefore, a right face (an outside face in the left and right directions) of the body part 61 is covered by the transmitting piece 57 of the transmitting member 24. In a rear lower part of the outer circumference face of the body part 61, a driving gear 64 is provided.

The body part 61 of the operation member 25 is rotatably attached to an outer circumference of the boss 35 of the base part 31 of the container body 21. Thereby, the operation member 25 is rotatably supported to the base part 31 of the container body 21 around the rotation axis X. The operation member 25 is provided so as to rotate between a first operation position (refer to FIG. 5) and a second operation position (refer to FIG. 6) with regard to the container body 21. As clearly shown in FIG. 5, when the operation member 25 is in the first operation position, the lever part 62 is inclined upwardly to the front side in accordance with rotation of the body part 61. Moreover, as clearly shown in FIG. 6, when the operation member 25 is in the second operation position, the lever part 62 is inclined upwardly to the rear side in accordance with rotation of the body part 61.

Incidentally, an arrow A in FIG. 5 indicates the operation direction (hereinafter, called as "operation direction A") when operating the operation member 25 from the first operation position (refer to FIG. 5) to the second operation position (refer to FIG. 6). In the present embodiment, the operation direction A is a direction going from the front side to the rear side along the forward and backward directions. An arrow B in FIG. 6 indicates the operation direction (hereinafter, called as "operation direction B") when operating the operation member 25 from the second operation position (refer to FIG. 6) to the first operation position (refer to FIG. 5). In the present embodiment, the operation direction B is a direction going from the rear side to the front side along the forward and backward directions.

The lever part 62 of the operation member 25 is located at a lower side from the upper face of the lid part 33 of the container body 21. In a state that the operation member 25 is in the second operation position (refer to FIG. 6), as viewed along the left and right directions, an angle difference θ between an extended line L1 of the inclined face 44 provided on the recessed part 42 of the lid part 33 and a center axis line L2 of the lever part 62 in the container body 21 is 0 to 45 degrees.

With reference to FIGS. 5-8, the shutter 26 of the toner container 12 is rotatably attached onto an outer circumference of the duct part 32 of the container body 21. Thereby, the shutter 26 is rotatably supported to the duct part 32 of the container body 21 around the rotation axis Y. The shutter 26 is provided so as to rotate between a closing position (refer to FIGS. 5 and 7) closing the discharging port 37 for the toner and an opening position (refer to FIGS. 6 and 8) opening the discharging port 37 for the toner with regard to the container body 21. That is, the shutter 26 is provided so as to open/close the discharging port 37 for the toner.

Onto the outer circumference face of the shutter 26, a following gear 68 is provided. The following gear 68 is meshed with the driving gear 64 provided in the body part 61 of the operation member 25. Thereby, the shutter 26 and the operation member 25 are connected to each other. In a right end (an end at the outside in the left and right directions) of the shutter 26, a noncircular locking piece 69 is provided.

Next, operation replenishing the toner from the toner container 12 to the developing device 8 in the image forming apparatus configured as described above will be described.

When the toner is replenished from the toner container 12 to the developing device 8, the toner container 12 is installed into the installation part 11, and in a state that the discharging port 37 for the toner is opened, the driving coupling 18 is rotated by a driving source (not shown).

When the driving coupling 18 is thus rotated, this rotation is transmitted to the agitating member 22 by the transmitting member 24 and the agitating member 22 is rotated. Thereby, the toner contained in the base part 31 and the lid part 33 of the container body 21 is agitated by the agitating member 22.

Moreover, when the driving coupling 18 is rotated as described above, this rotation is transmitted to the conveying member 23 by the transmitting member 24 and the conveying member 23 is rotated. Thereby, the toner contained in the base part 31 of the container body 21 is conveyed to the duct part 32 of the container body 21 along the left and right directions by the conveying member 23. The toner conveyed to the duct part 32 of the container body 21 is discharged to the outside of the container body 21 through the discharging port 37 for the toner and is applied to the developing device 8. Thereby, the toner is replenished to the developing device 8.

In the image forming apparatus configured as described above, in a state before the toner container 12 is used (a state before the toner container 12 is installed into the installation part 11), the operation member 25 is positioned at the first operation position (refer to FIG. 5). Therefore, the shutter 26 is held at the closing position (refer to FIGS. 5 and 7) and the shutter 26 closes the discharging port 37 for the toner.

When using the toner container 12, as shown in FIG. 3, a worker, such as a user or a serviceman, opens the upper cover 14 and installs the toner container 12 into the installation part 11 from the upper side. When the toner container 12 is thus installed into the installation part 11, the inclined face 44 provided in the recessed part 42 of the lid part 33 of the container body 21 faces to a front upper side (a side of the worker operating the operation member 25). Moreover, as shown in FIG. 5, the locking piece 69 of the shutter 26 is engaged with the locked gap 16 of the installation part 11.

Next, as indicated by the arrow A in FIG. 5, the worker operates the lever part 62 of the operation member from the front side to the rear side. By this operation, the operation member 25 is rotated from the first operation position (refer to FIG. 5) to the second operation position (refer to FIG. 6). When the operation member 25 is thus rotated, this rotation is transmitted to the shutter 26 and the shutter 26 is rotated from the closing position (refer to FIGS. 5 and 7) to the opening position (refer to FIGS. 6 and 8). Thereby, the shutter 26 opens the discharging port 37 for the toner.

Moreover, when the shutter 26 is rotated from the closing position (refer to FIGS. 5 and 7) to the opening position (refer to FIGS. 6 and 8) as described above, rotating position of the locking piece 69 of the shutter 26 with regard to the locked gap 16 of the installation part 11 is varied. According to this, since releasing of engagement of the locking piece 69 and the locked gap 16 is regulated, detachment of the toner container 12 from the installation part 11 is regulated. That is, the toner container 12 becomes the locked state. Next, the worker closes the upper cover 14. Thereby, preparation for use of the toner container 12 is completed.

On the other hand, when use of the toner container is finished, the worker opens the upper cover 14. Subsequently, as indicated by the arrow B in FIG. 6, the worker operates the lever part 62 of the operation member from the rear side to the front side. By this operation, the operation member 25 is rotated from the second operation position (refer to FIG. 6) to the first operation position (refer to FIG. 5). When the operation member 25 is thus rotated, this rotation is transmitted to the shutter 26 and the shutter 26 is rotated from the opening position (refer to FIGS. 6 and 8) to the closing position (refer to FIGS. 5 and 7). Thereby, the shutter 26 closes the discharging port 37 for the toner.

Furthermore, the shutter 26 is rotated from the opening position (refer to FIGS. 6 and 8) to the closing position (refer to FIGS. 5 and 7), as shown in FIG. 5, rotating position of the locking piece 69 of the shutter 26 with regard to the locked gap 16 of the installation part 11 is varied. According to this, since releasing of engagement of the locking piece 69 and the locked gap 16 is allowed, detachment of the toner container 12 from the installation part 11 is allowed. That is, the toner container 12 becomes the unlocked state. Next, the worker detaches the toner container 12 upwardly from the installation part 11.

As described above, the operation member 25 is configured so as to be operated by the worker between the first operation position (refer to FIG. 5) making the shutter 26 close the discharging port 37 for the toner and the second operation position (refer to FIG. 6) making the shutter 26 open the discharging port 37 for the toner.

Incidentally, in the toner container 12 of the present embodiment, because the operation member 25 and the shutter 26 are connected to each other by a gear mechanism (the driving gear 64 and the following gear 68), relatively large force is required for operating the operation member 25. Particularly, because the sealing member 38 preventing toner leak is located between the shutter 26 and the container body 21 and frictional force acting between the sealing member 38 and the shutter 26 becomes a load applied to operation of the operation member 25, force required for operating the operation member 25 becomes larger. According to this, it is feared that the worker hardly operates the operation member 25.

Figure 9:
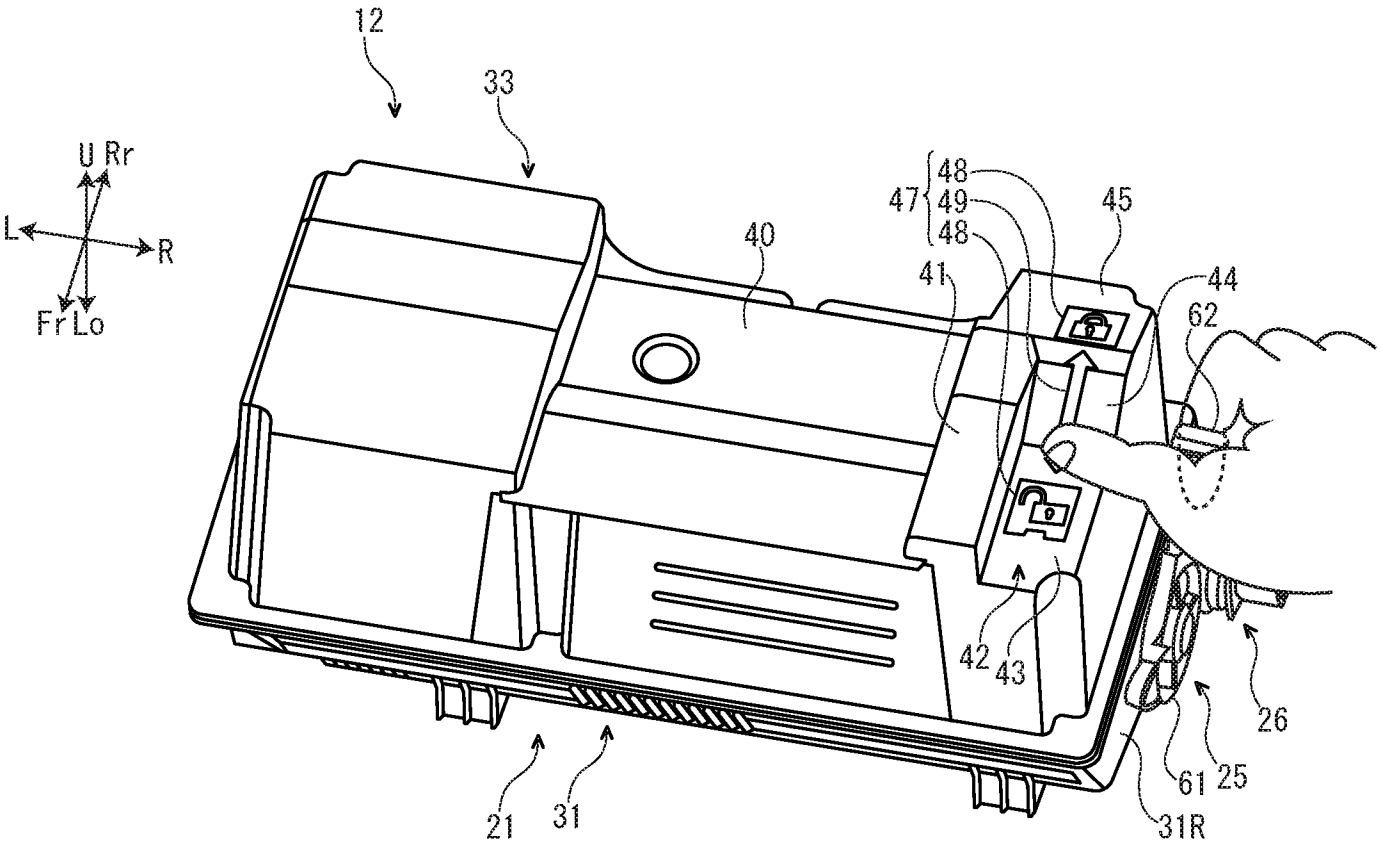
FIG. 9 is a perspective view showing the toner container, in a state that an operator operates the operation member, according to the embodiment of the present disclosure.

Thereupon, in the present embodiment, in the recessed part 42 of the upper face of the lid part 33, the inclined face 44 inclined upwardly from the front side (an upstream side in the operation direction A) to the rear side (a downstream side in the operation direction A) is provided. By applying such a configuration, as shown in FIG. 9, the worker can operate the lever part 62 of the operation member 25 with a forefinger in a state that the worker lays a thumb on the inclined face 44. Therefore, it is possible to enhance stability of a hand of the worker and to improve facility of operation of the operation member 25.

Particularly, by providing the inclined face 44 in the recessed part 42 of the upper face of the lid part 33 as described above, it is possible to restrain the thumb of the worker laid on the inclined face 44 from sliding to the left side (the inside in the left and right directions). Therefore, it is possible to more enhance stability of a hand of the worker and to more improve facility of operation of the operation member 25.

Moreover, in the state that the operation member is in the second operation position, the angle difference θ between the extended line L1 of the inclined face 44 and the center axis line L2 of the lever part 62 is 0 to 45 degrees. By applying such a configuration, the worker can easily operate the lever part 62 with the forefinger in the state that the worker lays the thumb on the inclined face 44. Therefore, it is possible to further improve facility of operation of the operation member 25.

In addition, a part of the direction indicating part 47 is provided in the inclined part 44. By applying such a configuration, the worker can easily see the direction indicating part 47 and can easily confirm the operation direction of the operation member 25.

Particularly, in the present embodiment, a part of the arrow 49 of the direction indicating part 47 is provided in the inclined part 44. By applying such a configuration, the worker can easily see the arrow 49 and can more easily confirm the operation direction of the operation member 25.

Further, in the state that the toner container 12 is installed in the installation part 11, the inclined face 44 faces to the front upper side (a side of the worker operating the operation member 25). By applying such a configuration, the worker can further easily see the arrow 49 and can further easily confirm the operation direction of the operation member 25.

Moreover, the recessed part 42 is provided at the right side (a side of the operation member 25) of the protrusion part 41 so as to continue to the protrusion part 41. By applying such a configuration, since it is possible to restrain the recessed part 42 from being greatly recessed downwardly, it is possible to keep decrease of a toner quantity of the container body 21 according to forming of the recessed part 42 minimize.

Furthermore, the position of the inclined face 44 in the forward and backward directions (the width direction of the container body 21) is overlapped to the position of the operation member 25 in the forward and backward directions regardless of the operation position of the operation member 25 as a whole. By applying such a configuration, the worker can easily operate the lever part 62 with the forefinger in the state that the worker lays the thumb on the inclined face 44. Therefore, it is possible to further improve facility of operation of the operation member 25.

In addition, the image forming apparatus 1 includes the above-described toner container 12 and the installation part in which the toner container 12 is detachably attached. By applying such a configuration, it is possible to provide the image forming apparatus 1 including the toner container 12 capable of improving facility of operation of the operation member 25.

Figure 10:
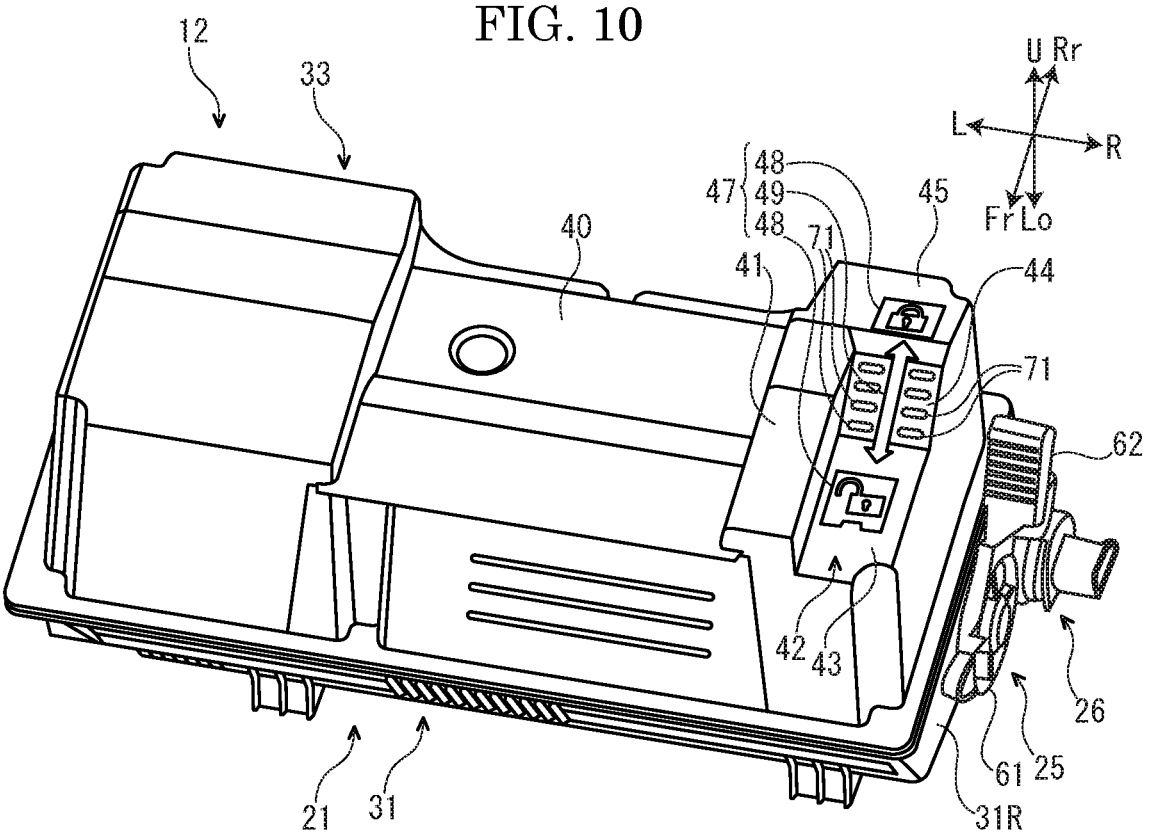
FIG. 10 is a perspective view showing the toner container according to a different embodiment of the present disclosure.
Figure 11:
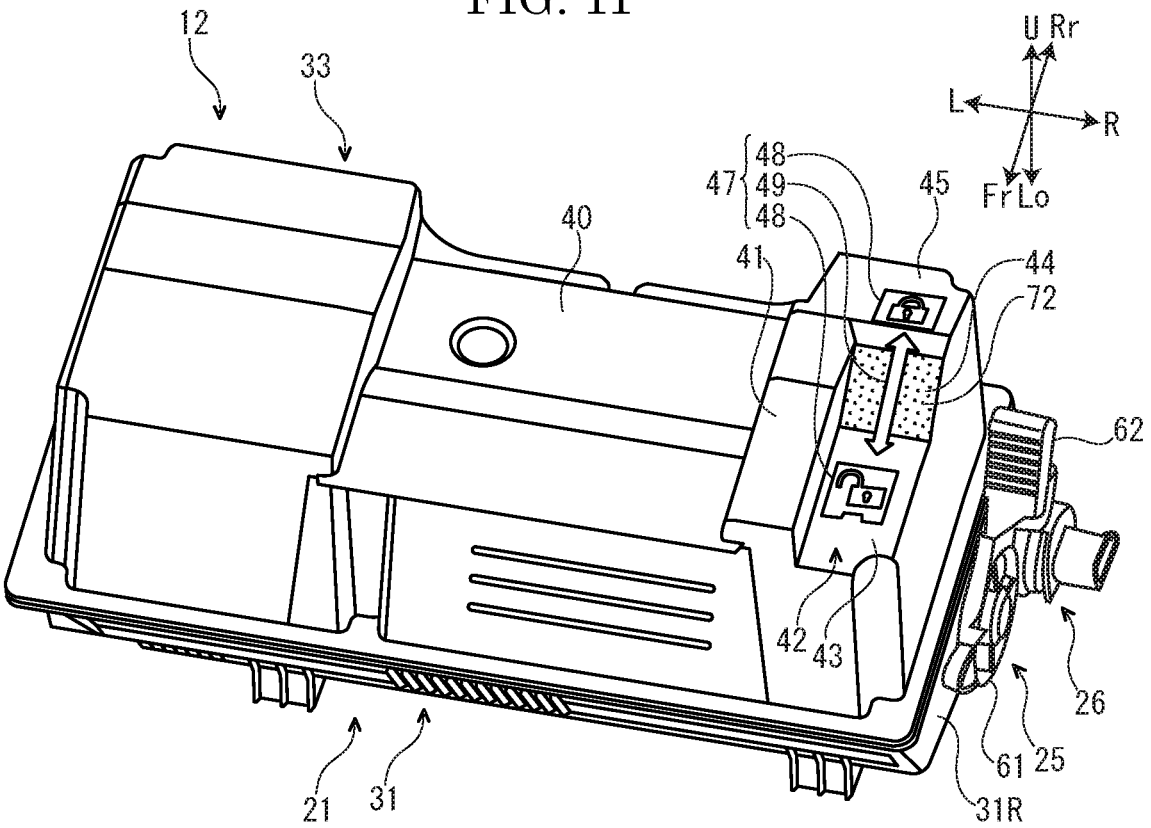
FIG. 11 is a perspective view showing the toner container according to a further different embodiment of the present disclosure.

The inclined face 44 of the present embodiment is flat except a part in which the arrow 49 of the direction indicating part 47 is arranged. On the other hand, as shown in FIG. 10, in the inclined face 44 of a different embodiment, a plurality of ribs 71 arranged along the operation direction of the operation member 25 may be provided at both sides of the arrow 49. Alternatively, as shown in FIG. 11, in the inclined face 44 of a different embodiment, emboss processing 72 may be applied. By applying such configuration, it is possible to restrain the thumb of the worker laid on the inclined face 44 from sliding to the operation direction of the operation member 25. Therefore, it is possible to further enhance stability of a hand of the worker and to further improve facility of operation of the operation member 25.

In the present embodiment, a part of the arrow 49 of the direction indicating part 47 is provided in the inclined face 44. On the other hand, in a different embodiment, the whole of the arrow 49 may be provided in the inclined face 44 or the whole of the direction indicating part 47 may be provided in the inclined face 44.

In the present embodiment, the recessed part 42 is provided in the right end (the end at the side of the operation member 25) of the upper face of the lid part 33. On the other hand, in a different embodiment, the recessed part 42 may be provided from the right end to a right side part of the upper face of the lid part 33 or the recessed part 42 may be provided from the right end to a center part in the left and right directions of the upper face of the lid part 33. That is, the recessed part 42 may be provided in any area in the upper face of the lid part 33 so long as its area includes the end at the side of the operation member 25 in the upper face of the lid part 33.

In the present embodiment, the image forming apparatus 1 is the printer. However, in another embodiment, the image forming apparatus 1 may be a copying machine, a facsimile, a multifunction peripheral (an image forming apparatus compositely including a print function, a copy function, a facsimile function and others) or the like.

The above-description of the embodiment of the present disclosure was described about a preferable embodiment of the toner container and the image forming apparatus according to the disclosure. However, the technical scope of the present disclosure is not limited to the embodiments.

The invention claimed is:

1. A toner container comprising:

a container body containing a toner and having a discharging port discharging the toner;

a shutter opening/closing the discharging port; and an operation member being operated between a first operation position making the shutter close the discharging port and a second operation position making the shutter open the discharging port, wherein in an upper face of the container body, a recessed part is provided in an area including an end at a side of the operation member, in the recessed part, an inclined face inclined upwardly from an upstream side to a downstream side in an operation direction when the operation member is operated from the first operation position to the second operation position is provided, in the upper face of the container body, a protrusion part is provided, and the recessed part is provided at the side of the operation member of the protrusion part so as to continue to the protrusion part.

2. The toner container according to claim 1, wherein the operation member includes:

a body part rotatably attached to the container body; and a lever part linearly extended from an outer circumference face of the body part, in a state that the operation member is in the second operation position, an angle difference between an extended line of the inclined face and a center axis line of the lever part is 0 to 45 degrees.

3. The toner container according to claim 1, wherein in the upper face of the container body, a direction indicating part indicating the operation direction of the operation member, at least a part of the direction indicating part is provided in the inclined face.

4. The toner container according to claim 3, wherein the direction indicating part includes a pair of marks; and an arrow being provided between the pair of marks and indicating the pair of marks, at least a part of the arrow is provided in the inclined face.

5. A toner container comprising:

a container body containing a toner and having a discharging port discharging the toner:

a shutter opening/closing the discharging port; and an operation member being operated between a first operation position making the shutter close the discharging port and a second operation position making the shutter open the discharging port, wherein in an upper face of the container body, a recessed part is provided in an area including an end at a side of the operation member, in the recessed part, an inclined face inclined upwardly from an upstream side to a downstream side in an operation direction when the operation member is operated from the first operation position to the second operation position is provided, and in the inclined face, a plurality of ribs arranged along the operation direction of the operation member are provided.

6. The toner container according to claim 1, wherein in the inclined face, emboss processing is applied.

7. The toner container according to claim 4, wherein the pair of marks includes a mark being provided at an upstream side from the arrow and illustrating an unlocked state, and a mark being provided at a downstream side from the arrow and illustrating a locked state.

8. A toner container comprising:

a container body containing a toner and having a discharging port discharging the toner:

a shutter opening/closing the discharging port; and an operation member being operated between a first operation position making the shutter close the discharging port and a second operation position making the shutter open the discharging port, wherein in an upper face of the container body, a recessed part is provided in an area including an end at a side of the operation member, in the recessed part, an inclined face inclined upwardly from an upstream side to a downstream side in an operation direction when the operation member is operated from the first operation position to the second operation position is provided, the operation member includes a body part rotatably attached to the container body, and a lever part linearly extended from an outer circumference face of the body part, in a state that the operation member is in the second operation position, an angle difference between an extended line of the inclined face and a center axis line of the lever part is 0 to 45 degrees, the inclined face is inclined upwardly from a front side to a rear side, and the lever member is extended upwardly from the outer circumference face of the body part, and is inclined upwardly to a front side when the operation member is in the first operation position, or is inclined upwardly to a rear side when the operation member is in the second operation position.

9. An image forming apparatus comprising:

the toner container according to claim 1; and an installation part to which the toner container is detachably attached.

10. An image forming apparatus comprising:

the toner container according to claim 3;

an apparatus body; and an installation part to which the toner container is detachably attached, the installation part being arranged in a front upper part of the apparatus body, wherein the inclined face faces to a front upper side in a state that the toner container is installed to the installation part.

11. A toner container comprising:

a container body containing a toner and having a discharging port discharging the toner;

a shutter opening/closing the discharging port; and an operation member being operated between a first operation position making the shutter close the discharging port and a second operation position making the shutter open the discharging port, wherein in an upper face of the container body, a recessed part is provided in an area including an end at a side of the operation member, in the recessed part, an inclined face inclined upwardly from an upstream side to a downstream side in an operation direction when the operation member is operated from the first operation position to the second operation position is provided, and in the recessed part, a horizontal face is provided at the upstream side from the inclined face in the operation direction so as to continue to the inclined face.

* * * * *